United States Patent [19]

Bergeron

[11] Patent Number: 4,792,279

[45] Date of Patent: Dec. 20, 1988

[54] VARIABLE PITCH PROPELLER

[76] Inventor: Robert M. Bergeron, Whithers Grove, Derry, N.H. 03038

[21] Appl. No.: 93,016

[22] Filed: Sep. 4, 1987

[51] Int. Cl.[4] ..... B63H 1/06

[52] U.S. Cl. ..... 416/89; 416/87; 416/167

[58] Field of Search ..... 416/89, 87, 167

[56] References Cited

U.S. PATENT DOCUMENTS

| | | | |
|---|---|---|---|
| 1,449,685 | 3/1923 | Luther et al. | 416/89 |
| 1,953,682 | 4/1934 | Kelm | 416/89 |
| 2,244,994 | 6/1941 | Humphrey | 416/80 |
| 2,282,077 | 5/1942 | Moore | 416/89 |
| 2,415,421 | 2/1947 | Filippis | 416/89 |
| 2,998,080 | 8/1961 | Moore, Jr. | 416/167 |
| 3,853,427 | 12/1974 | Holt | 416/167 |

FOREIGN PATENT DOCUMENTS

| | | | |
|---|---|---|---|
| 667260 | 7/1963 | Canada | 416/167 |
| 230132 | 3/1944 | Switzerland | 416/89 |

*Primary Examiner*—Robert E. Garrett
*Assistant Examiner*—Therese Newholm
*Attorney, Agent, or Firm*—Davis, Bujold & Streck

[57] ABSTRACT

An automatic variable pitch propeller comprising a central hub defining an axis of propeller rotation and a plurality of blades connected to and extending from said central hub substantially normal to the axis of rotation, each blade being mounted for rotation about a pitch axis, means to translate outward movement of that blade resulting from centrifugal forces imposed on that blade by rotation of the propeller into a force tending to rotate that blade about its pitch axis toward a feathered pitch condition, the force being opposed by a feathering force acting at a center pressure of the blade offset from the pitch axis, caused by resistance to rotation of said propeller and tending to decrease blade pitch toward a feathered condition.

1 Claim, 3 Drawing Sheets

VARIABLE PITCH PROPELLER

The present invention relates to an automatically self-adjusting variable pitch propeller and more particularly, though not exclusively, to marine-type propellers.

It is known in the art that under conditions when load is high and speed is low, a propeller with a low pitch provides for the most efficient translation of engine power to propulsion. However, when higher propeller speeds are attained it is known that a propeller with a higher pitch is desirable. Thus a propeller which has a variable pitch is advantageous in terms of both performance and extended engine life.

The prior art relating to automatic variable pitch propellers relies on the use of counter forces provided by springs and the like to act against the centrifugal force on the blades of a rotating propeller. Alternatively, mechanical means such as hydraulics are used. Much of the art related to propellers concerns the airplane type. One method (see U.S. Pat. No. 2,998,080 issued to MOORE on Aug. 20, 1961) of automatically adjusting the pitch is to provide a semi-hollow propeller blade with an angled slot, an inner support member which has a guide pin that intersects said slot and a spring acting to apply a force on the blade toward the axis of rotation of a central hub. When the propeller is not rotating, the springs apply a constant force on the blades. This force urges them toward the axis of rotation on the hub. In this stationary position, the pitch of the blades is low. As the propeller begins to turn, the blades are subjected to centrifugal force. When the centrifugal force exceeds the opposing force provided by the spring the blades moves outwards. Because the guide pin intersects the angled slot on the blade, the movement of the blade outward is controlled by the movement of the guide pin along the angled slot. Since the slot is angled the blade must rotate when moving away from the central hub. Thus, centrifugal force is translated into the rotation of the blade as well as an outward movement, and the pitch changes accordingly. When the speed of the blade is reduced, the centrifugal force is reduced and the constant force provided by the spring causes the pitch to be changed by the similar but opposite means of movement.

Other U.S. patents known to Applicant are WEIHER, U.S. Pat. Nos. 1,389,609; KELM, 1,953,682; HAMILTON, 2,264,568; MOBERG, 4,392,832; SHIMA, . 3,552,348; MacLEAN, 3,092,186; DALEY, 2,955,659; GASTON, . 2,742,097; EVANS, 2,682,926; ROSSMAN, 2,681,632 and GORMAN, 630,499. All of the above references disclosed variable pitch propeller devices. Of these the most relevant is MOORE, discussed above and the following four.

The WEIHER reference pertains to an airplane propeller having pin 15 contained in slots 17, 18 of tubes 10, 11. As the tubes 10, 11 are drawn outwardly by centrifugal force, pin 15 causes the pitch of blades 4,6 to increase.

The KELM reference relates to an automatic variable pitch airplane propeller. As the prop speed increases, the centrifugal force exerted on the blades 14 causes the blades, the shanks, and the associated parts to be thrown radially outward thus compressing spring 41. This causes shift pin 45, acting upon cam slot 46, to turn shank 15 and blade 14 about their radial axis to a lowest pitch position thereby increasing the grip of the blade 14 on the air.

The HAMILTON reference also relates to an airplane propeller having a variable pitch. The apparatus has spiral apertures P acting with cross pins T to change the pitch of the blade I. The change in the blade pitch depends upon whether the blade movement is outward due to centrifugal force or inward due to the action of spring Q.

The reference of MOORE discloses a marine type propeller having an automatically variable propeller blade pitch. The centrifugal force is converted to pitch change by a camming pin 28 and helical slot 20 arrangement. A resilient member 34 held in place by a pressure plate 35 provides an opposing force.

The MOBERG reference relates to a steering and propulsion unit for a marine craft. The most relevant teaching of this reference is shown in FIG. 5 where a bore 47 is in fluid contact with hydraulic cylinder 60 so that fluid pressure forces piston 63 upward which in turn induces a feathering of the propeller blade 62.

To provide a variable pitch propeller blade, it is necessary to provide means for opposing centrifugal force. The method universally employed by all the prior art is to provide a resilient or hydraulic means to generate a force to act against centrifugal force. The balance between the opposing forces can be used in cooperation with an angled slot and guide pin to effect the changing of pitch of a propeller blade. This changing of pitch is regulated only by and a function of the speed of the propeller and has the disadvantage of not being responsive to load.

It is an object of the present invention to provide an improved means for automatically adjusting the pitch of a propeller blade to allow optimization of the performance of the propulsion system over a greater range of operating conditions than previously achieved.

Adjustment of pitch is accomplished by balancing the centrifugal force of the blades against the force on the blades resisting rotation of the propeller.

To achieve this relationship, an angled slot type means is used whereby when centrifugal force acts to move the blade away from the central hub it acts to urge the blade to rotate about a blade pitch change axis. This rotation causes the pitch of the blade to increase. Simultaneously, force due to resistance to rotation acts on the blade to oppose the pitch increase and to tend to cause its rotation to decrease its pitch accordingly. This rotation simultaneously moves the blade, by virtue of the angle slot type means, toward the center of the hub in opposition to the tendency to move it away caused by the centrifugal force.

Thus, when the propeller is in motion, two opposing forces are created which act to rotate each blade about its pitch change axis. Therefore, the pitch of the blade is determined by the relative magnitude of the forces applied; both of which are derived from the rotation of the propeller assembly. Furthermore, as the speed of the propeller increases centrifugal force increases at a greater rate than the force produced by resistance to rotation. Thus, when the propeller's rotation is slow, the pitch change force produced by resistance to rotation overcomes that produced by centrifugal force. As rotational speed increases, centrifugal force increases faster than the opposing force and eventually exceeds it. Therefore, when the propeller's rotation is slow, the force produced by resistance to rotation ensures that the pitch of the blade is kept low. As the rotational speed increases, the more rapidly increasing centrifugal force eventually causes the pitch to increase against the opposing force. Thus, the pitch is a function of the speed of the propeller and the resistance to propeller rotation and can be varied over a broad range of speeds to optimize performance. The pitch of the blade is dynamic according to the respective values of these forces. Optimum performance can thus be obtained.

The present invention accomplishes these desired operating parameters and also has another advantage. The optimum diameter of a propeller traveling under low power is small. As the torque at the propeller increases it is desirable to increase the diameter. When the torque is high a larger diameter of the propeller allows for more efficient operation of the engine. Accordingly, because of the design of the present invention, the increase in pitch associated with the increase in speed additionally causes an increase in diameter of the propeller. Since applied torque is high under most high pitch/diameter operation of the propeller (and vice versa), the design which is the present invention further optimizes performance, engine life and efficiency.

The present invention in the form of a marine propeller will now be described, by way of example, with reference to the accompanying drawings, in which.

Figure 1:
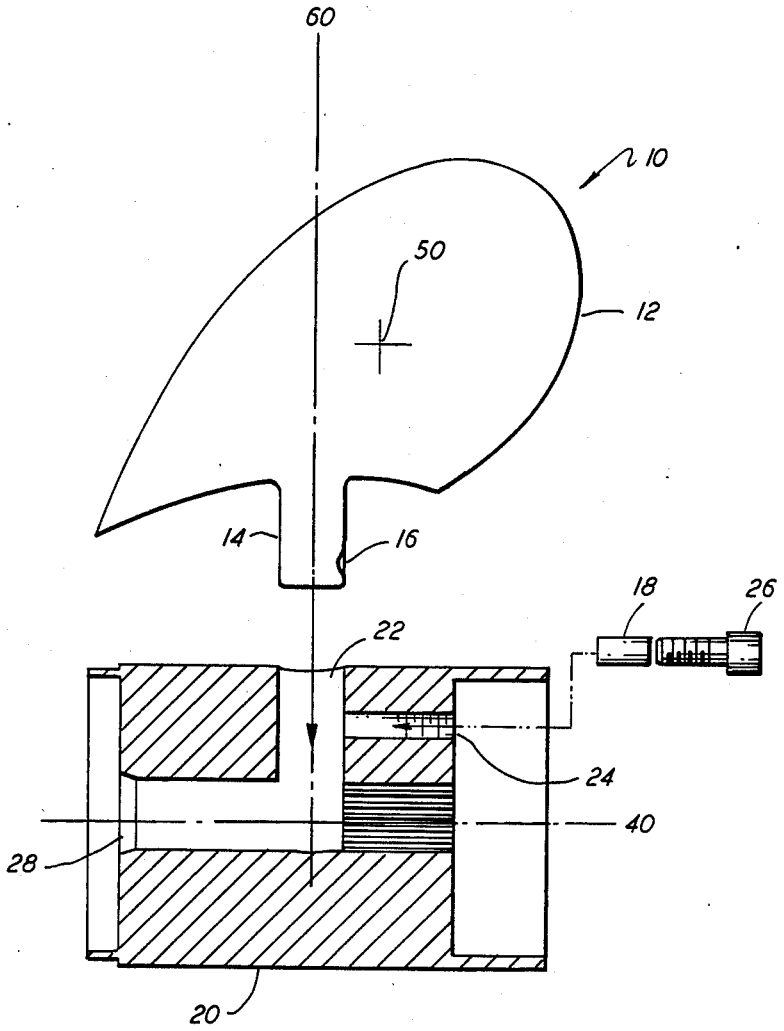
FIG. 1 is a disassembled partially cross-sectioned elevation of a propeller assembly according to the invention.

Referring to FIG. 1, the arrangement therein shows three propeller blades (10), each having a blade face (12) and a blade shaft (14). Blade shaft (14) has a helical groove (16). A substantially cylindrical central hub (20) contains three bores (22) extending radially from the axis of rotation (40) of the hub (and propeller assembly) each adapted to rotably receive a blade shaft (14). The rotation of the blade shaft (14) in a radial bore (22) is restricted by the length of the helical groove (16) when a guide pin (18) is passed through a guide pin bore (24) to intersect blade shaft (14) and rest within helical groove (16). The guide pin (18) secured therein by guide pin screw (26). Central hub (20) additionally defines an axially extending drive shaft bore (28) which receives a motor powered drive shaft (not shown).

Figure 2:
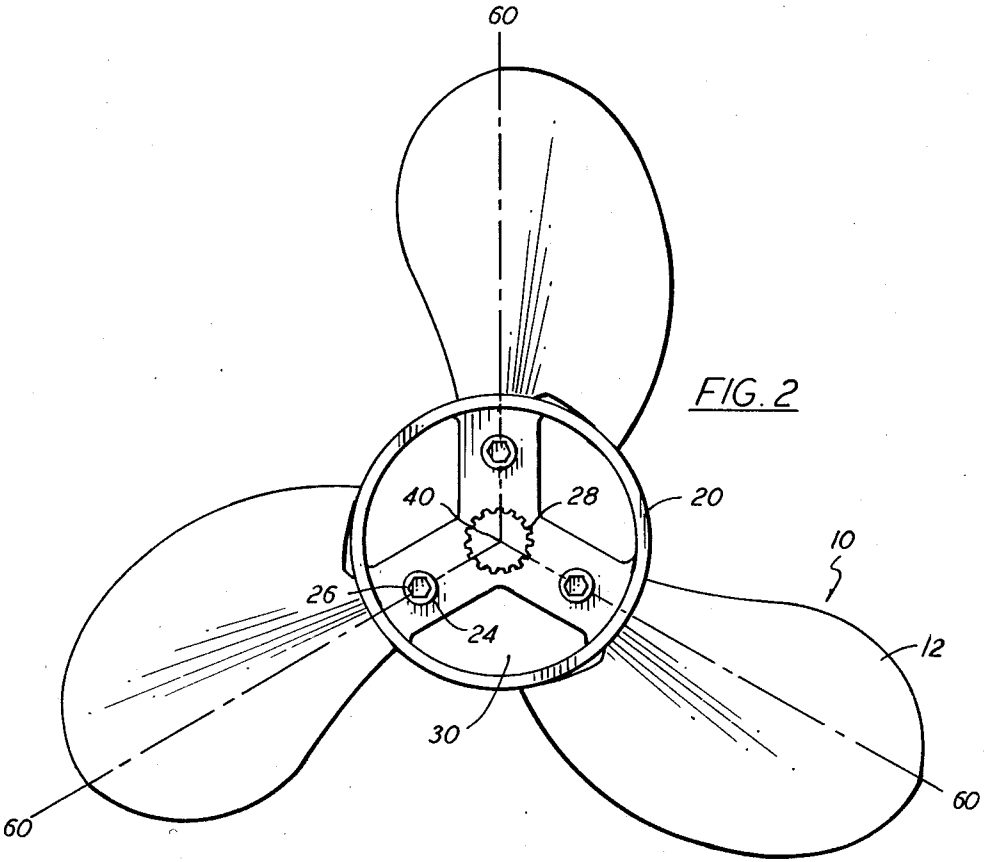
FIG. 2 is an end elevation of the propeller assembly.

Referring to FIG. 2, the rotation of a drive shaft (not shown) secured in the drive shaft bore (28) causes rotation of the central hub (20) about its axis of rotation (40). Centrifugal force resulting from rotation of the central hub (20) acts on the blades (10) to move them outwardly away from the axis of rotation (40). Central hub (20) additionally contains three substantially triangular ports (30), running longitudinally therethrough parallel to the axis of rotation (40), capable of venting exhaust gases from the attached motor (not shown).

Figure 3:
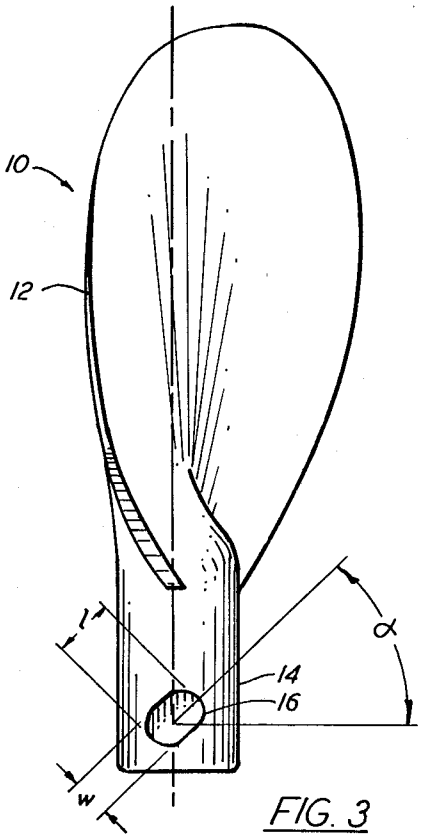
FIG. 3 is a side elevation of a propeller blade of the propeller.

Taking FIGS. 1, 2 and 3 together, helical groove (16) has a length (l), width (w) and angle ($\alpha$) on blade shaft (14). When blade (10) rotates in radial bore (22) with the guide pin (18) secured in place in helical groove (16) by guide screw (26), such rotation can only occur with movement of the entire propeller blade relative to the axis of rotation (40).

When the central hub (20) and blades (10) are rotated about the axis of rotation (40), centrifugal force acts on the blades (10). The blades (10) cannot move away from the central hub (20) without rotating in the radial bore (22) because the interaction of guide pin (18) and helical groove (16) which controls and defines the range of movement. Similarly, when the central hub (20) and blades (10) are rotated about the axis of rotation (40) resistance from contact with water exerts a resultant force on the blade face (12). This force acts at a center of pressure (50) on the blade face (12). The center of pressure 50 is displaced from the pitch change axis (60) defined by the axis of the associated radial bore (22) to produce a force opposing that produced by centrifugal force to urge rotation of the blade(s) (10) in the radial bore (22) in the opposite direction to the rotation caused by centrifugal force. Due to the guide pin (18) and the helical spline (16), the rotation of blade shaft (14) in radial bore (22) necessitates the movement of the blade (10) inward toward the axis of rotation (40) of the central bore (20) in the direction opposite and against centrifugal force.

Blade rotation occurs according to the length and angle of helical groove (16) on blade shaft (14) which is engaged by guide pin (18) secured to central hub (20) by guide pin screw (26). The design and shape of blade face (12) and the angle of helical groove (16) is such that the rotation caused by force on the center of pressure (50) results in blade (10) moving along helical groove (16) inwardly toward the axis of rotation (40) of the central hub (20).

The helical groove (16) on blade shaft (14) is disposed at angle $\alpha$ to the length of the shaft (14). The range of pitches which the propeller may have is a function of this angle $\alpha$ and length of groove (16). Similarly, the diameter range available to the propeller assembly is also a function of these values.

When the central hub (20) begins to turn about axis of rotation (40) the force of resistance on blade face (12) caused by contact with water yields a resultant force on the center of pressure (50). This force on the center of pressure (50) initially exceeds the centrifugal force acting on the blades (10). Accordingly, the rotation of the blade (10) within radial bore (22) will be about pitch axis (60) in the direction of the force on center of pressure (50). Helical groove (16) disposed on blade shaft (14) is at an angle $\alpha$ such that rotation of blade (10) about pitch axis (60) results in a decrease in pitch (toward a feathered condition) and movement of the blade (10) inward towrad the central hub (20). Thus, decrease in pitch is accompanied by decrease in diameter.

As the speed of the central hub (20) increases, the centrifugal force on the blades (10) increases at a greater rate than the increase in force due to resistance. Thus, the centrifugal force will eventually equal and then exceed the force of water resistance. When this occurs, blade (10) moves away from the central hub (20). This movement is accompanied by rotation of the blade (10) in the radial bore (22) about the pitch axis (60). This rotation is in the opposite direction of that caused by the force of water resistance. Therefore, the rotation due to centrifugal force causes the blade face (12) to move against the center of pressure (50) to a coarser pitch. Thus, as the speed increases both the pitch and diameter of the blade also increase.

Figure 4:
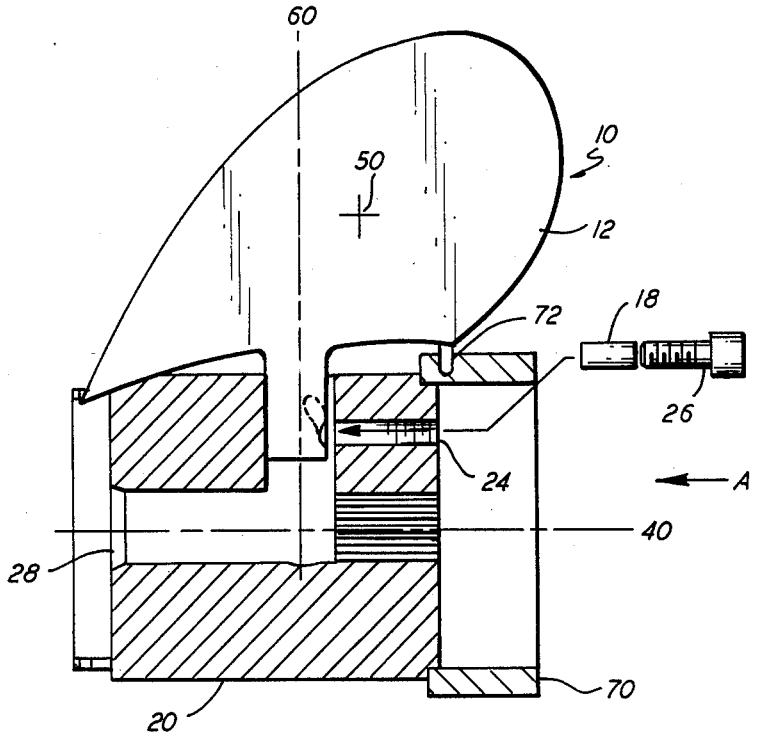
FIG. 4 is a side elevation of another embodiment of a propeller assembly.
Figure 5:
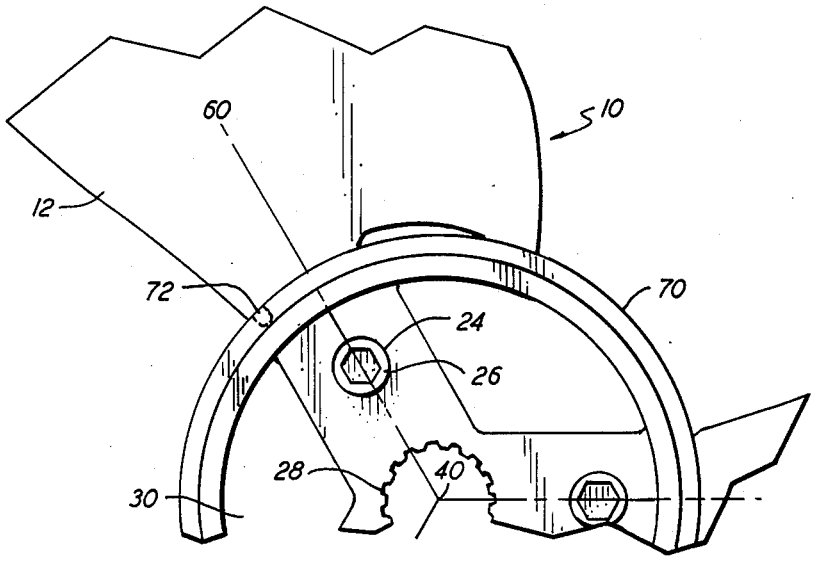
FIG. 5 is a partial end elevation as shown by Arrow A in FIG. 4.

Referring to FIG. 4, an addition to the above embodiment shows a ring (70) mounted on the rear end of the central hub (20). This ring may be used in combination with attaching means (72) which serve to connect that ring to the ends of the blades (10). According to this design, the additional ring (70) is free to rotate about the axis of rotation (40) on the central hub (20). When the blades (10) are connected to the ring (70) with the attachment means (72), the rotation of the blade (10) about the axis of pitch rotation (60) is synchronized. This synchronization occurs because movement of the blades (10) about the pitch axis of rotation (60) causes movement of the attachment means (72) which turns ring (70). The movement of the ring (70) causes all blades (10) to move equal amounts in synchronism.

The above embodiment is meant to survey as an example of the present invention and not meant to limit it in any way. Many alternative embodiments are possible including propeller assemblies having more or less than three blades.

Additionally, it will be appreciated that the helical groove/pin arrangements could be replaced by other mechanisms for positively transmitting outward movement of a blade into pitch rotation of that blade without departing from the inventive concept, for example, a radial helical cam surface with cam follower could be used.

I claim:

1. An automatic variable pitch variable diameter marine propeller comprising:

a central hub defining rotation axis, said central hub having three exhaust ports extending longitudinally therethrough, three radial bores interdigitated with said ports, each of said radial bores receiving one of three propeller blade shafts, and three guide pin bores each receiving one of three guide pins, each of said guide pin bores being parallel to said propeller rotation axis and intersecting perpendicularly with a said radial bore;

three propeller blades, each of said blades comprising a said blade shaft and a blade portion, said blade shaft being attached to said blade portion at one end and extending away from said blade portion into a said radial bore, said blade shaft being capable of rotation within said radial bore about an axis of pitch rotation, said axis of pitch rotation being normal to said axis of propeller rotation, said blade shaft having a helical groove in its periphery to receive a said guide pin, said blade portion being configured and attached to said blade shaft such that force due to water pressure on said blade portion defines a center of pressure which is located remote from the axis of pitch rotation;

each of said guide pins passing through a said guide pin bore and being recieved by said helical groove wherein, said helical groove defines pitch of the associated said propeller blade by controlling its rotation within said radial bore about its axis of pitch rotation; and synchronization means to synchronize the varying pitches of the propeller blades, comprising a ring rotatably mounted on said central hub, and attachment means locating said propeller blades relative to the ring; wherein said rotation of said propeller blade shaft in said radial bore about said axis of pitch rotation to change the pitch of its propeller blade is accompanied by a change in diameter of said propeller, said changes in pitch and diameter are restricted by the limited rotation of said blade shaft within said radial bore defined by the length of the helical groove and the interaction of said guide pin therewith;

centrifugal force acting on said propeller blades due to rotation of said propeller about said propeller rotation axis tends to move propeller blades radially outwardly, to increase propeller diameter, said increased diameter being controlled by said guide pins interacting with said helical groove and resulting in an accompanying increase in pitch of said propeller blade, said force due to water pressure on said propeller blades, when said propeller is rotating about said propeller rotation axis, acting at said center of pressure tends to cause said propeller blade to rotate within said radial bore about said axis of pitch rotation, to tend to cause propeller blades to move inwardly, to decrease propeller diameter, toward said central hub as controlled by said guide pins interacting with said helical groove with an accompanying decrease in pitch of said propeller blades;

forces tending to increase pitch and diameter resulting from centrifugal force are opposed by forces tending to reduce pitch and diameter resulting from force due to water pressure acting on said propeller blades such that when these pitch and diameter changing forces are balanced against each other a desired propeller pitch and diameter for existing operating conditions is produced.

* * * * *